US005889366A

United States Patent [19]

Yokokawa et al.

[11] Patent Number: 5,889,366

[45] Date of Patent: Mar. 30, 1999

[54] FLUORESCENT LAMP OF THE EXTERNAL ELECTRODE TYPE AND IRRADIATION UNIT

[75] Inventors: Yoshihisa Yokokawa; Motomori Tada, both of Himeji; Masaki Inoue, Takasago; Masaki Yoshioka, Himeji, all of Japan

[73] Assignee: Ushiodenki Kabushiki Kaisha, Tokyo, Japan

[21] Appl. No.: 981,008

[22] PCT Filed: Apr. 4, 1997

[86] PCT No.: PCT/JP97/01160

§ 371 Date: Dec. 24, 1997

§ 102(e) Date: Dec. 24, 1997

[87] PCT Pub. No.: WO97/41589

PCT Pub. Date: Nov. 6, 1997

[30] Foreign Application Priority Data

Apr. 30, 1996 [JP] Japan ..... 8-109109
Jun. 6, 1996 [JP] Japan ..... 8-144121

[51] Int. Cl.[6] ..... H01J 11/00

[52] U.S. Cl. ..... 313/607; 313/631; 313/114

[58] Field of Search ..... 313/594, 607, 313/631, 635, 113, 114

[56] References Cited

FOREIGN PATENT DOCUMENTS 0 312 732 4/1989 European Pat. Off. .
0 521 553 1/1993 European Pat. Off. .
HEI 7-313704 8/1995 Japan .

*Primary Examiner*—Vip Patel
*Attorney, Agent, or Firm*—Sixbey, Friedman, Leedom & Ferguson; David S. Safran

[57] ABSTRACT

The invention relates to a fluorescent lamp of the external electrode type and an irradiation unit using this fluorescent lamp. In a fluorescent lamp of the external electrode type, a glass tube with fluorescent material applied to its inside is hermetically filled with a suitable amount of rare gas, in the axial direction of the outside surface of the glass tube there is at least one pair of electrodes, and on the side which is opposite the aperture for emission of the light to the outside there is reflector material. The electrodes are at least partially translucent, and the reflector material is located in these translucent regions. In this way the electrostatic capacity of the lamp is not significantly reduced even if the electrodes are partially provided with translucent regions. The energy input into the lamp thus has a value which would be obtained essentially even if the translucent regions were absent. Therefore the light intensity can be increased according to the arrangement of the reflector material. The translucent regions can have any shapes, as in the form of slits, openings or the like. Furthermore, in a fluorescent lamp of the external electrode type the external electrodes exhibit light transmission. When the lamp is being operated the light is emitted to the outside from the aperture, and at the same time the light is emitted from the translucent regions which are located in the external electrodes. The light emitted from the translucent regions is reflected from a reflector device and is radiated from the opening of this U-shaped reflector device. Light intensity can be increased by the measure that the external electrodes of the lamp are partially translucent and that the light passed by the translucent regions is reflected by this reflector device and is radiated onto a region to be irradiated.

3 Claims, 13 Drawing Sheets

Cross section perpendicular to the tube axis of the fluorescent lamp of the external electrode type, in which the electrodes are provided with translucent regions Schematic cross section of one embodiment of the fluorescent lamp of the external electrode type as claimed in the invention perpendicular to the axial direction FIG. 2
Schematic of the arrangement of a fluorescent lamp of the external electrode type, which was used in the experiment as claimed in the invention
| | Electrode form | No reflector component present in the electrode parts | Reflector component present in the electrode parts |
|---|---|---|---|
| 1 | 8mm (a) | ****** | 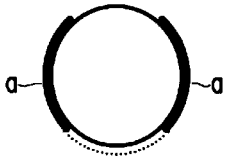 |
| 2 | 1–2–5mm (a) (b) (c) | 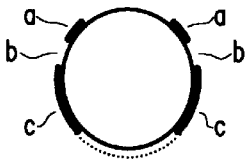 | 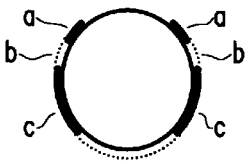 |
| 3 | 3–2–3mm (a) (b) (c) | 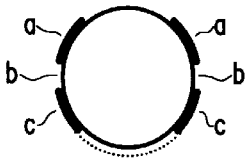 | 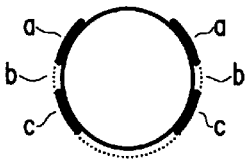 |
| 4 | 5–2–1mm (a) (b) (c) | 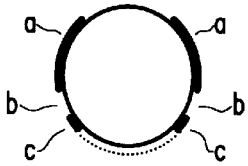 | 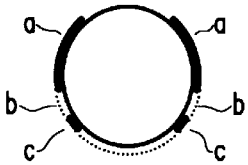 |
| 5 | 6mm (a) | 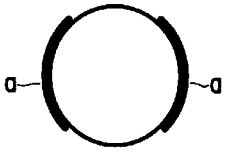 | 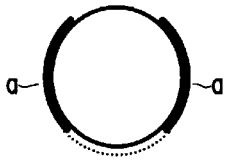 |
(Width of aperture is in each case 4mm)
FIG. 2a
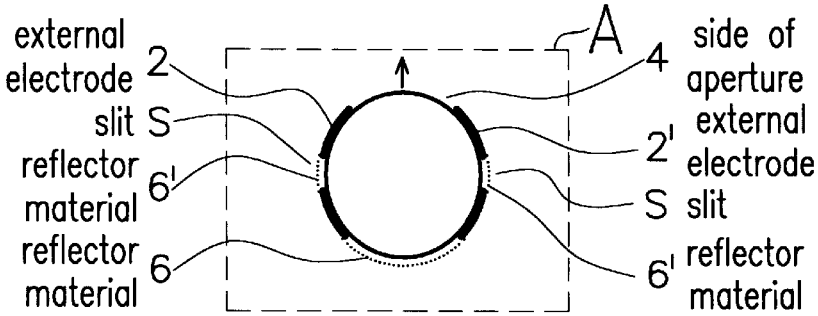

Schematic of the relation between the electrode shape and the illuminance

Schematic of the electrostatic capacity when the width and the form of electrodes has been changed Schematic of another electrode form in the embodiment as claimed in the invention Schematic of the installation of the reflector material in the embodiments as claimed in the invention FIG. 7 Schematic of an example of the fluorescent lamp of the external electrode type
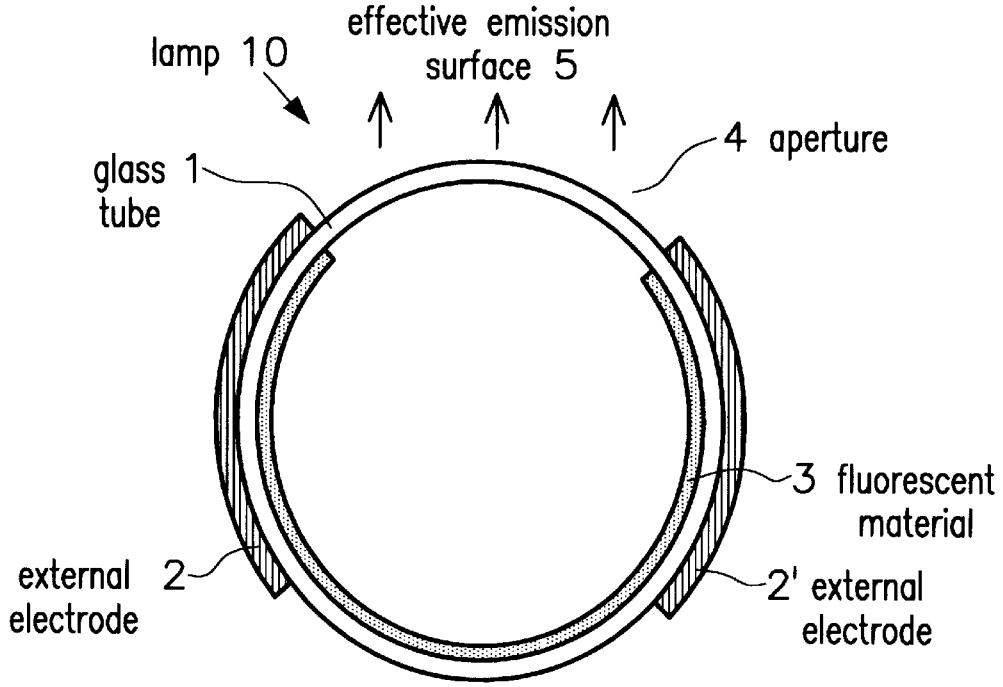
FIG. 8 Schematic of a fluorescent lamp of the external electrode type in which there is reflector material arranged
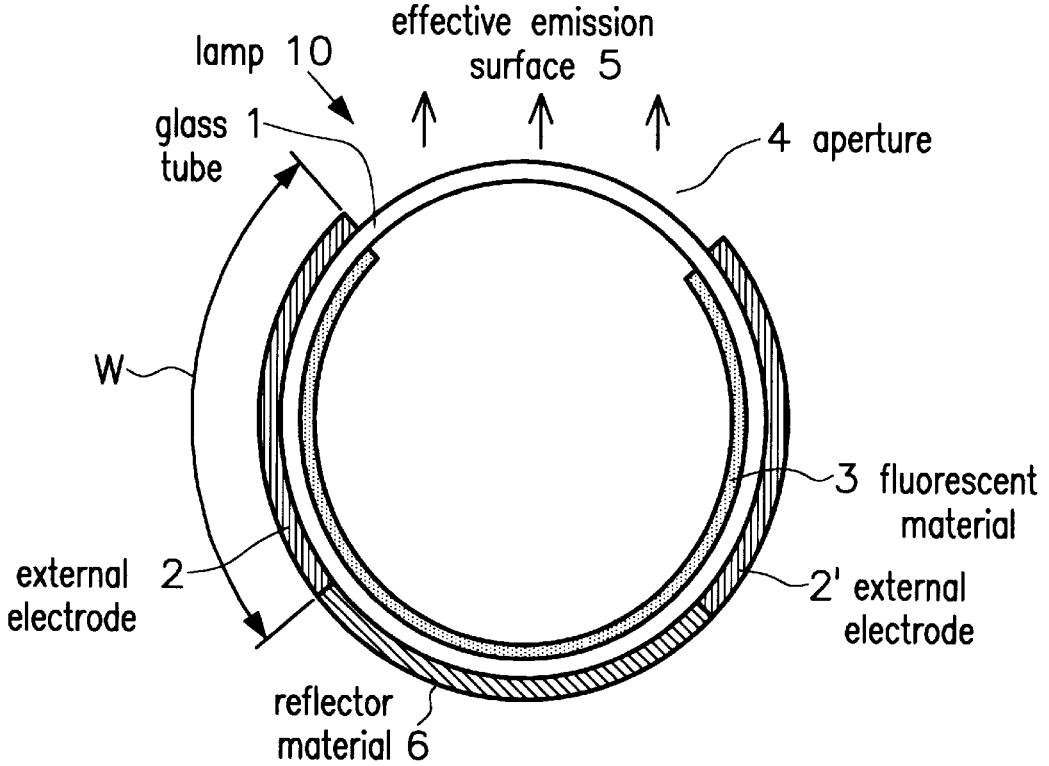

Schematic of an arrangement of a first embodiment of an irradiation unit as claimed in the invention Cross section perpendicular to the tube axis of the fluorescent lamp of the external electrode type, in which the electrodes are provided with translucent regions Schematic of the result of a comparison experiment in the first embodiment Schematic of the arrangement of a second embodiment of the irradiation unit as claimed in the invention Schematic of the result of a comparison experiment in the second embodiment Schematic of the arrangement of a conventional irradiation unit used in an experiment according to Fig.8

Schematic of a measurement result of the distribution of the light intensity of the irradiation units shown in Figures 5 and 6

FLUORESCENT LAMP OF THE EXTERNAL ELECTRODE TYPE AND IRRADIATION UNIT

FIELD OF THE INVENTION

The invention relates to a fluorescent lamp of the external electrode type which is used for document scanning illumination which is used for an information processing device such as a fax machine, character/image reader and the like, and for a back light device of a liquid crystal display cell and for similar purposes.

DESCRIPTION OF RELATED ART

As a fluorescent lamp which is used for a scanning light source of an office automation device and for back light of a liquid crystal display device and the like, a fluorescent lamp of the external electrode type is known in which on the outside surface of a glass tube there is a pair of strip-like external electrodes to which a high frequency voltage is applied for operating.

FIG. 7 is a schematic of one example of the fluorescent lamp of the external electrode type which is shown in a cross section perpendicular to the tube axis of the fluorescent lamp of the external electrode type. As is shown in the drawing, in fluorescent lamp 10 of the external electrode type the outside of glass tube 1 is provided with a pair of strip-like external electrodes 2, 2'. Glass tube 1 is filled with a rare gas or the like. Fluorescent material 3 is applied to the inside of glass tube 1. An uninterrupted high frequency voltage or pulse-like high frequency voltage is applied to external electrodes 2, 2' to operate the lamp.

In fluorescent lamp 10 of the external electrode type a discharge is produced between external electrodes 2 and 2' by the high frequency voltage applied to the pair of external electrodes 2, 2' in the discharge space within glass tube 1. Fluorescent material 3 applied to the inside of glass tube 1 is caused to emit by the UV radiation which is formed by this discharge. The light formed by the discharge is radiated to the outside from aperture 4 and the side opposite it. The light emitted from aperture 4 is radiated onto the article to be irradiated.

In the fluorescent lamp the light radiated to the outside from the side opposite aperture 4 is not effectively used. The intensity of the light with which the article to be irradiated is irradiated drops accordingly.

The applicant has therefore proposed a technique for increasing the light intensity, in which reflector material is applied to the side opposite aperture 4 of fluorescent lamp 10 of the external electrode type (Japanese Patent Application HEI 7-313704).

FIG. 8 is a cross sectional view perpendicular to the tube axis of the fluorescent lamp of the external electrode type, in which the aforementioned reflector material is applied. In the Figure the electrode width is labeled W.

In this technique reflector material 6 is applied to the side opposite aperture 4, as is shown in FIG. 8. During an emission by the discharge the light emerging from aperture 4 of fluorescent lamp 10 of the external electrode type is increased by the light reflected by reflector material 6. Thus emission by discharge can be effectively used without placing a reflector or the like outside of fluorescent lamp 10 of the external electrode type.

In an information processing device such as a fax machine, copier, image reader and the like, however, recently there has been a demand to increase the document scanning speed. There is accordingly a demand to increase the light intensity of a fluorescent lamp of the external electrode type. Furthermore, for a back light device of a liquid crystal display cell a back light device is desirable in which high light intensity can be obtained with low input power.

If the fluorescent lamp of the external electrode type described above using FIG. 8 is used, emission by discharge can be effectively used and thus the light intensity of a fluorescent lamp of the external electrode type can be increased. To adequately meet this demand, it is however desirable to increase the light intensity even more.

SUMMARY OF THE INVENTION

The invention was devised to eliminate this disadvantage. The object of the invention was to devise a fluorescent lamp of the external electrode type in which the light intensity can be increased even more, and an irradiation unit using the fluorescent lamp.

In the fluorescent lamp of the external electrode type shown in FIG. 8, on the side opposite aperture 4 is reflector material 6. The light intensity of fluorescent lamp 10 of the external electrode type is increased by adding the light reflected by reflector material 6 to the emission light by discharge. This means that by effectively using the reflector material the light intensity of the fluorescent lamp of the external electrode type is increased.

To increase the light intensity therefore an attempt was made to more efficiently use the reflector material. For this reason the emitted light was studied in the case of an arrangement of translucent regions on one part of the electrodes and an arrangement of the reflector material in these translucent regions.

First, the intensity light emitted from the fluorescent lamp of the external electrode type was studied when only translucent regions are located in the electrodes. This showed the following:

When the electrode width (W in FIG. 8) is reduced, the emerging light emitted from the fluorescent lamp of the external electrode type is usually reduced. In the case of an arrangement of gaps (hereinafter called "slits") in one part of the electrodes however the emerging light emitted from the fluorescent lamp of the external electrode type is not greatly reduced with a suitable choice of the positions and the size of these slits, even if the electrode width (electrode area) becomes smaller according to the arrangement of the slits.

It can be imagined that the reason for this is as follows:

When the electrode width is reduced, ordinarily the electrostatic capacity of the fluorescent lamp of the external electrode type diminishes. The power supplied to the fluorescent lamp of the external electrode type decreases accordingly. In the case of an arrangement of slits in the electrodes however the electrode areas (regions in which the electrodes spread) including the slits do not change.

Therefore the slits act almost like in a state in which the electrodes would be present in the slit areas. It can therefore be imagined that the electrostatic capacity of the fluorescent lamp of the external electrode type does not decrease significantly, and that as a result the emerging light emitted from the fluorescent lamp of the external electrode type hardly drops at all. In particular it has been found that the decrease of light intensity is less, the nearer the slots to the aperture as loaded.

Next, light intensity in the case of an arrangement of the reflector material in the slits was studied. This showed that by arranging the reflector material in the slits the light intensity increases compared to the case without arrangement of the reflector material and that the light intensity in this case is greater than the light emergence of the fluorescent lamp of the external electrode type shown above in FIG. 8, as is described below.

Furthermore, the light intensity was studied by changing the type of reflector material. This showed that the increase of light intensity is not significantly dependent on the reflection factor or the reflector material and that the light intensity increases also in the case in which the reflection factor of the reflector material is smaller than the reflection factor of the electrode.

Light intensity does decrease slightly by the arrangement of the translucent regions, like the slots or the like, in the electrodes. By the arrangement of the reflector material in these translucent regions however the light intensity of the fluorescent lamp of the external electrode type can be increased. It can be imagined that as a result the light intensity can be increased more strongly than in the fluorescent lamp of the external electrode type shown above in FIG. 8, in which only the side opposite the aperture is provided with reflector material.

The reflection factor of the reflector material need not always be higher than the reflection factor of the electrode. It was found that even in the case in which the reflection factor of the reflector material is lower than the reflection factor of the electrode, the light intensity of the fluorescent lamp of the external electrode type can be increased.

In the experiment, the electrodes were provided with slits and the light intensity studied. However, it can be imagined that the same result can be obtained even if the electrodes are provided with openings instead of with slits.

According to the invention, in this way the light intensity of a fluorescent lamp of the external electrode type is increased.

The object is achieved as claimed in the invention as follows:

(1) In a fluorescent lamp of the external electrode type in which a glass tube with fluorescent material applied to its inside is hermetically filled with a suitable amount of rare gas, in which in the axial direction of the outside surface of the glass tube there is at least one pair of electrodes, and in which there is an aperture for emission of the light to the outside, the electrodes are at least partially translucent, and the reflector material is located in these transparent regions.

(2) In (1) the translucent regions are located in the vicinity of the aperture.

If the principle is used that in an arrangement of translucent regions such as slits or the like, the intensity of the light emitted from the aperture is not decreased in the external electrodes by means of a suitable choice of the size and the positions and the like of these translucent regions, and even if the electrode areas decrease according to the arrangement of the translucent regions, then still another arrangement can be effected.

This means that outside of the arrangement of the reflector material in these translucent regions, an increase of the usable light intensity at the same lamp input power is enabled by a reflector component being located on the outside of the lamp, by the light emitted from the translucent regions being reflected by this reflector component, and by the article to be irradiated with this light being irradiated without its being guided back into the inside of the glass tube.

Proceeding from this state of affairs, in an irradiation unit with a fluorescent lamp of the external electrode type, in the fluorescent lamp of the external electrode type a glass tube with a fluorescent material applied to its inside being hermetically filled with a suitable amount of rare gas, in the axial direction of the outside surface of the glass tube at least one pair of electrodes being located, and there being one aperture for emission of light to the outside, the object as claimed in the invention is furthermore achieved by the electrodes being at least partially translucent, by a reflector device being located at a distance from the fluorescent lamp of the external electrode type, and by the light passed by the electrodes being at least partially reflected by this reflector device in the region which is irradiated with the radiant light from the aperture.

In the following the invention is further described using several embodiments shown in the drawings.

BRIEF DESCRIPTION OF THE DRAWINGS

FIG. 2 and 2A each show a schematic of the arrangement of a fluorescent lamp of the external electrode type which was used in the experiment of invention;

FIG. 7 shows a schematic of an example of the fluorescent lamp of the external electrode type;

FIG. 8 shows a schematic of a fluorescent lamp of the external electrode type in which there is reflector material arranged;

DETAILED DESCRIPTION OF PREFERRED EMBODIMENTS

Figure 1:
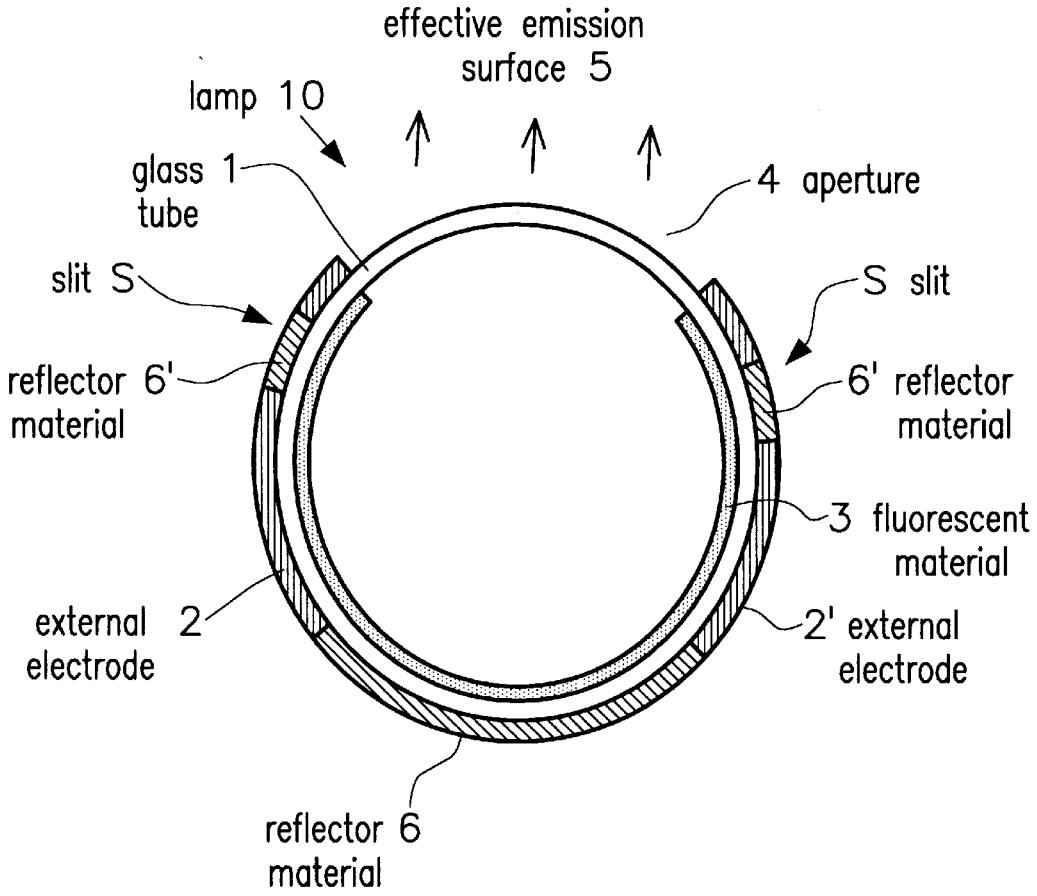
FIG. 1 shows a schematic cross section of one embodiment of the fluorescent lamp of the external electrode type of the invention, perpendicular to the axial direction.

FIG. 1 is a schematic of one embodiment of the invention. It is a schematic cross section of the fluorescent lamp of the external electrode type, the cross section perpendicular to the tube axis. In this embodiment reference number 10 labels a fluorescent lamp of the external electrode type (hereinafter called simply a "lamp") with external electrodes 2, 2' provided with slits as translucent regions S. Reflector material 6' is applied to these slits S. In the figure fluorescent material 3 is applied to the inside of glass tube 1 and the inside undergoes the stipulated evacuation and is then filled with rare gas which has xenon gas as the main component. The two ends of glass tube 1 are sealed. Fluorescent material 3 is removed from that inner side of the glass tube between external electrode 2 and 2' which forms aperture 4 and this region acts as effective emission surface 5.

In the axial direction of glass tube 1 are strip-like electrodes 2, 2' which for example are formed from metal strips, such as Al, Cu and the like, or conductive enamel, such as silver paste and the like. Electrodes 2, 2' are provided with slits S. In these slits S and on the side opposite aperture 4 is reflector material 6, 6'. In the figure a case is shown in which slits S are located on the aperture sides of electrodes 2, 2' and in which reflector material 6' is located in these slits S. However slits S (and pertinent reflector material 6) can be located elsewhere on electrodes 2, 2', as was described below.

Reflector material 6 was used which was produced by adding a binder to aluminum oxide and applying it to the outside of glass tube 1 in a thin layer and drying it. Besides aluminum oxide, barium sulfate, magnesium oxide, titanium oxide, calcium pyrophosphate or the like can be used as reflector material 6. Furthermore, without being limited to the material, reflector strips with a white color, silver color or the like which consist of a material with electrical insulation can be used. The electrical insulation of reflector material 6 has the effect to prevent creeping discharge of external electrodes 2, 2' on the surface of glass tube 1.

In the lamp with this arrangement, the electrode width and positions of slits S were changed and the emergence of the light emitted from the lamp was studied in the case of an arrangement of the reflector material at the locations of these slits S and in the case of no reflector material. In this experiment lamps with a tube diameter of 8 mm and lamp length of 360 mm were used. The lamps were operated by applying a pulse-like high frequency voltage. However it can be imagined that the same result is obtained even if a high frequency AC voltage is applied to the lamps.

FIGS. 2 and 2A schematically show the electrode widths of the lamps used in the experiment and the positions of slits S. FIG. 2A shows aperture 4 at the top, electrodes using the thick lines and reflector material 6 using the broken line. Furthermore, in FIG. 2A the widths of electrodes 2, 2' and slit S are labeled a to c. Other components such as fluorescent material and the like are not shown.

FIG. 2 shows a case (1) in which electrode width is 8 mm, in which there is no slit and in which reflector material 6 is located on the side opposite aperture 4.

Furthermore (2) shows a case in which electrode width is 8 mm, and in which slits S of 2 mm are located in electrodes 2, 2' at sites which are 1 mm away from aperture 4. (Width of the remaining electrode parts is 5 mm, as is shown in FIG. 2.)

(3) shows a case in which electrode width is 8 mm, and in which slits S of 2 mm are located in electrodes 2, 2' at sites which are 3 mm away from aperture 4. (Width of the remaining electrode parts is 3 mm, as is shown in FIG. 2.)

Furthermore (4) shows a case in which electrode width is 8 mm, and in which slits S of 2 mm are located in electrodes 2, 2' at sites which are 5 mm away from aperture 4. (Width of the remaining electrode parts is 1 mm, as is shown in FIG. 2.)

(5) shows a case of electrode width of 6 mm. In (2) through (4) a case of an arrangement of reflector material 6' in slits S and a case of no reflector material are shown. Furthermore, in (2) through (4) on the side of the lamp opposite aperture 4 there is reflector material 6, as in (1). In the lamps with electrodes with the respective form as shown in FIG. 2 the light intensity in the case of no reflector material in slits S of the electrode parts was studied. Then the light intensity was studied in the case of the arrangement of the reflector material in slits S.

Figure 3:
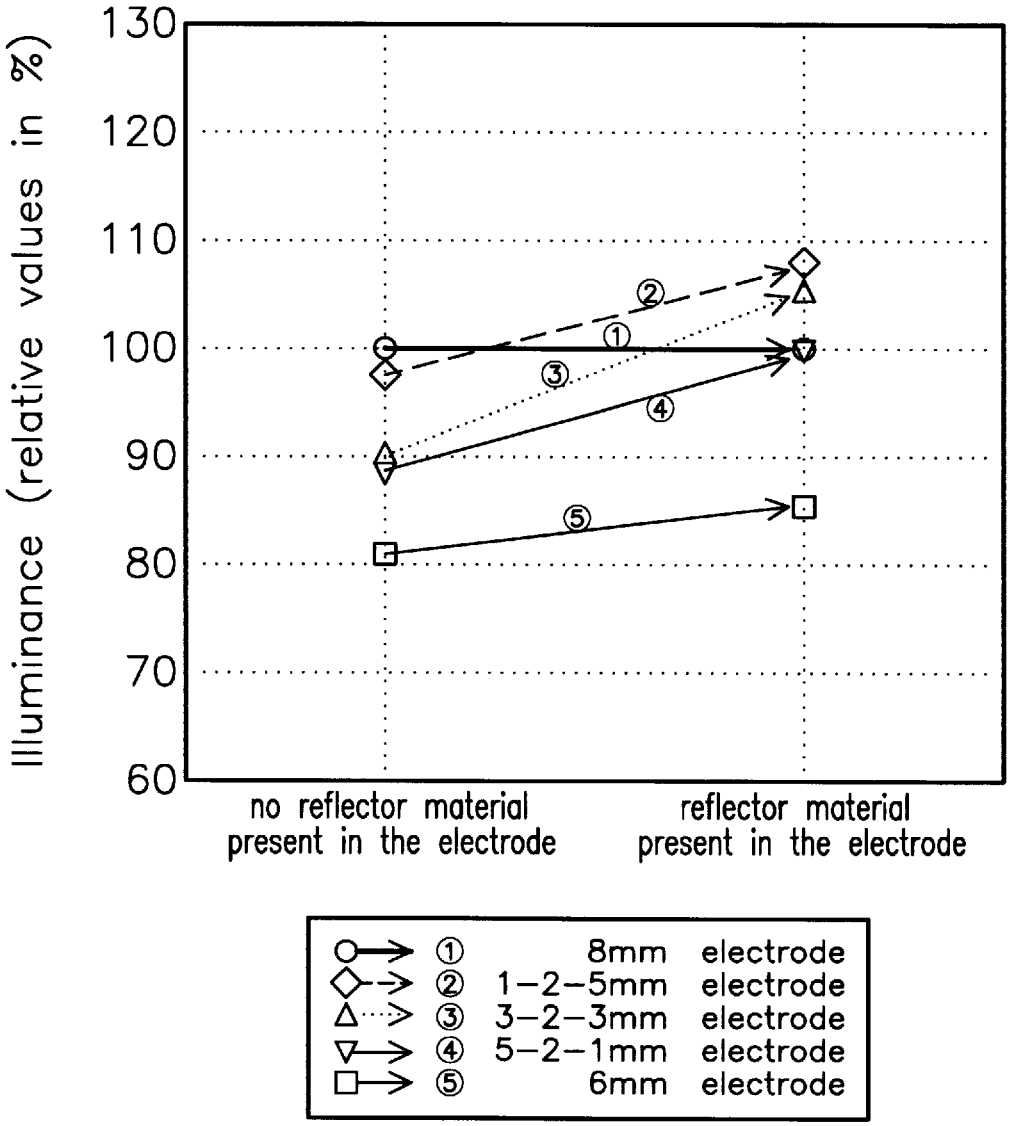
FIG. 3 shows a schematic of the relation between the electrode shape and the illuminance.

FIG. 3 is a schematic of the experiment result. In the Figure the Y-axis is the illuminance (relative values in %) of the respective lamp, the illuminance of the lamp with an electrode width of 8 mm being designated 100. Furthermore, the x-axis represents the case of the arrangement of reflector material 6' in slits S of electrodes 2, 2' in the lamps with the respective electrode shape and the case of no reflector material. In FIG. 3, (1) through (5) correspond to (1) through (5) in FIG. 2, as for example (1) shows the case of an electrode width of 8 mm and (2) the case of the electrode form of 1-2-5 mm.

The illuminance for an electrode width of 8 mm is shown for comparison with the illuminance of the lamps in the embodiment as claimed in the invention. Here the value of the illuminance is shown in the case in which in both cases of "no reflector material in the electrode parts" and "reflector material in the electrode parts" on the side opposite aperture 4 there is reflector material 6 (in the Figure the value of the illuminance for an electrode width of 8 mm in the case of "no reflector material in the electrode parts" is therefore identical to the value of the illuminance at an electrode width of 8 mm in the case of "reflector material in the electrode parts").

As the drawing shows, the maximum illuminance can be obtained when in an electrode form of 1-2-5 mm, reflector material 6' is located in the electrode parts. Furthermore in the case of an electrode form of 5-2-1 mm essentially the same illuminance as the illuminance in the case of the electrode width of 8 mm can be obtained by reflector material 6' being located in the electrode parts.

It can be imagined that the reason for this lies in the following:

Even if slits S are located in the electrodes, an electrostatic capacity is obtained in the slit region which corresponds roughly to the state in which the electrodes would be present in the slit regions, as was described above. The energy input into the lamp therefore does not decrease greatly even if the actual electrode width diminishes. Furthermore, the amount of light emerging can be increased by the arrangement of reflector material 6'. As a result thereof the yield of light emitted from the lamp can be increased.

At an electrode width of 6 mm on the other hand the illuminance decreases significantly compared to the case of the electrode width of 8 mm. The illuminance also decreases significantly in comparison to cases of an electrode form of 1-2-5 mm, 3-2-3 mm and 5-2-1 mm.

It can be imagined that the reason for this is as follows:

In the case of slits S located in the electrodes with an electrode width of 8 mm, a electrostatic capacity is obtained which corresponds essentially to a state in which the electrodes would be cemented on over a wide area, as was described above. Conversely, in the case of an electrode width of 6 mm, the electrostatic capacity of the lamp decreases accordingly. As a result the energy input into the lamp also decreases.

To confirm this state of affairs, in the lamps with the electrode form shown in FIG. 2, the electrostatic capacity of the respective lamp in the case of no reflector material 6' was studied.

Figure 4:
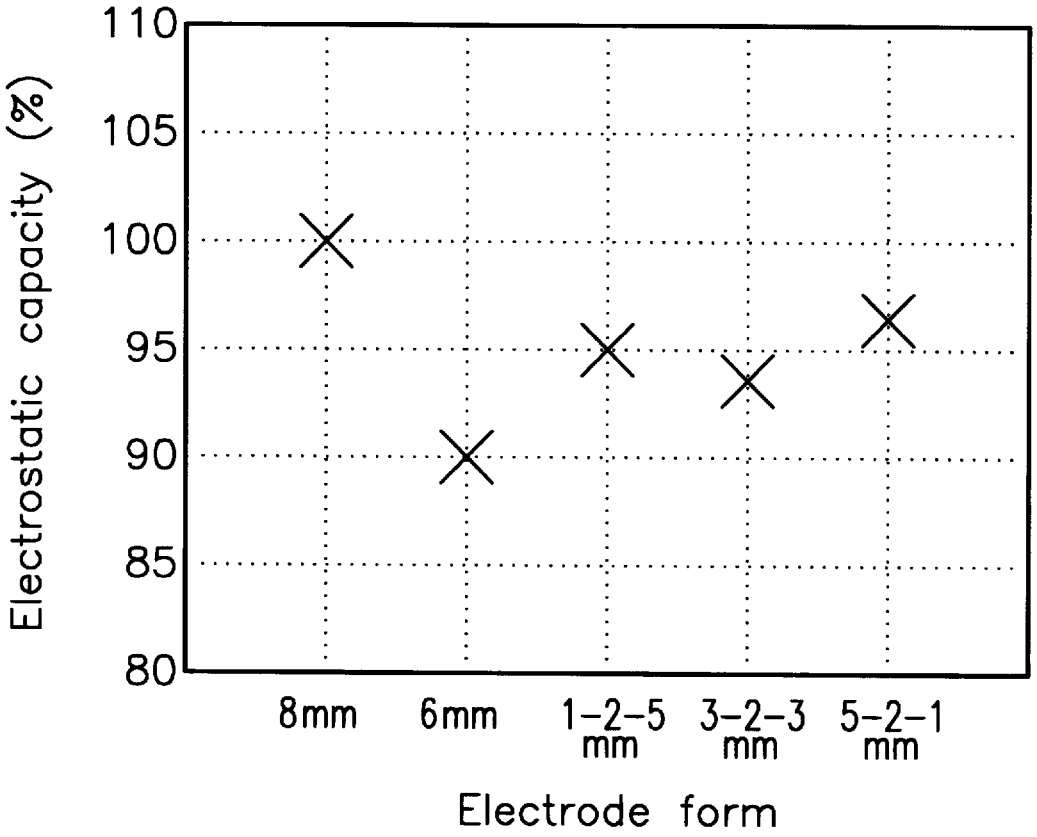
FIG. 4 shows a schematic of the electrostatic capacity when the width and the form of the electrodes has been changed.

FIG. 4 shows the electrostatic capacity. In the Figure, the electrostatic capacity (relative values in %) is shown in the case of an electrode with a width of 6 mm, in the case of an electrode with the form described above for (2) (1-2-5 mm), in the case with an electrode with the form described above for (3) (3-2-3 mm) and in the case of an electrode with the form described above for (4) (5-2-1 mm), the electrostatic capacity in the case of the arrangement of the electrode with a width of 8 mm being designated 100.

As the drawing shows, the electrostatic capacity decreases when the electrode width is reduced from 8 to 6 mm. In the case of arrangement of slits S in the electrodes however it becomes apparent that the electrostatic capacity does not decrease significantly, even if the electrode width decreases according to slits S (even if the electrode area is reduced). As was described above the slits act almost as in a state in which the electrodes would be present in the slit regions if there are slits S in the electrodes. Here the electrostatic capacity does not significantly decrease. Therefore almost the same effect can be obtained when cementing on the electrodes over a wide area.

It was possible to confirm from the result of the experiment that by the arrangement of slits S and application of the reflector material to the slit regions a higher illuminance can be achieved than in the case of an arrangement of electrodes without slits S.

Figure 5A:
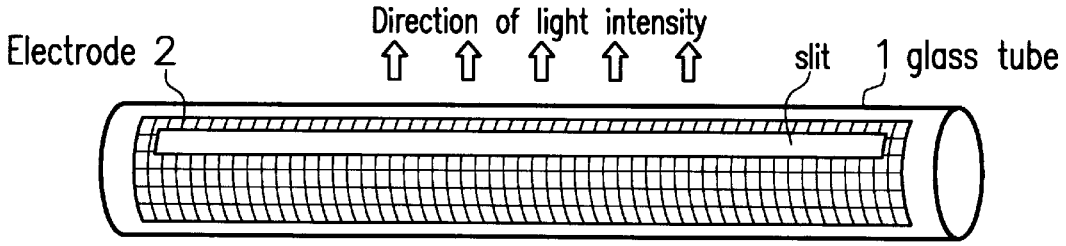
FIGS. 5A–5E each show a schematic of another electrode form in the embodiment of the invention.

In this embodiment the case of the arrangement of the reflector material in slits S which are located in the electrodes was described. However it can be imagined that the same effect can be obtained when, in the electrodes, other than the slit shape shown FIG. 5A, sizes, and arrangements of the openings, the lattice distance and the like are provided in a suitable manner, as is shown in FIGS. 5B to FIG. 5E.

Figure 5B:
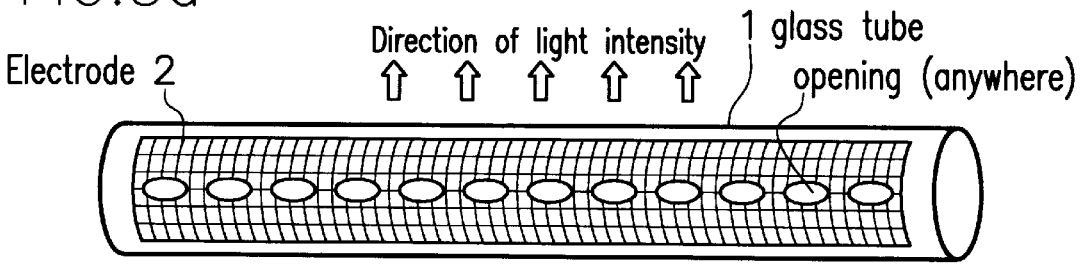
Figure 5C:
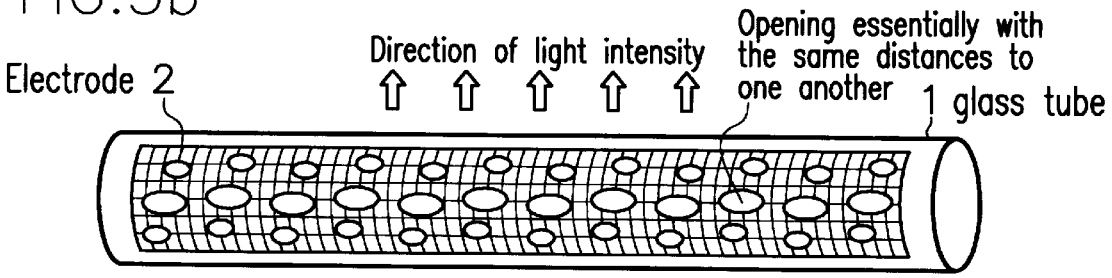
Figure 5D:
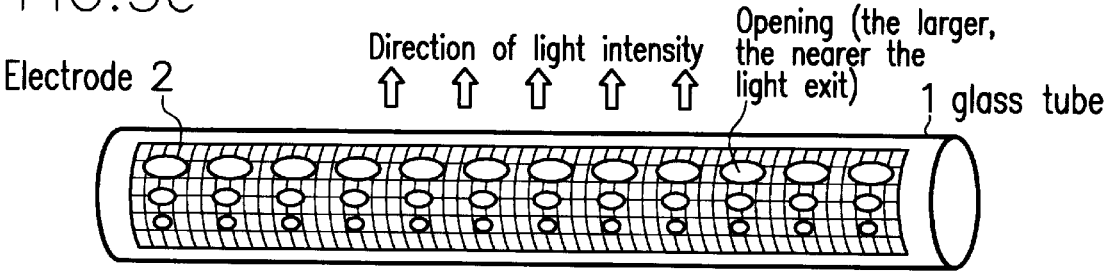
Figure 5E:
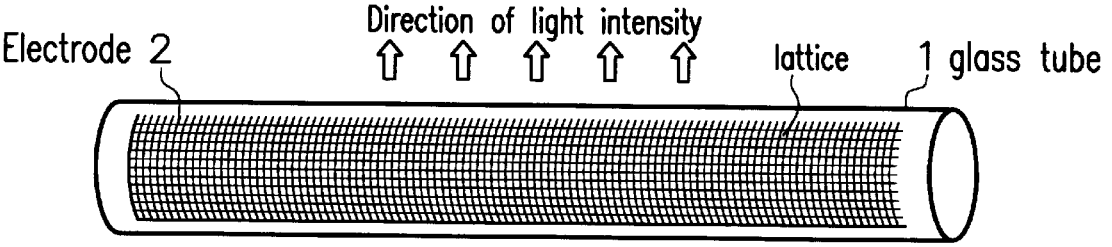

This means that electrode 2 can be provided with openings, as is shown in FIG. 5B, or the entire electrode 2 can also be provided with openings with the same distances to one another, as is shown in FIG. 5C. Furthermore, electrode 2 can be provided with openings such that the openings become larger, the nearer they are located to the light exit side (aperture), as is shown in FIG. 5D. In addition, the electrode can be formed from a lattice. In the respective translucent region there can furthermore be reflector material 6'.

In this embodiment a case is shown in which the fluorescent material is applied on the inside of the glass tube which corresponds to the regions provided with reflector material 6,6'. But the fluorescent material can also be removed in the regions which are provided with reflector material 6,6'.

Figure 6A:
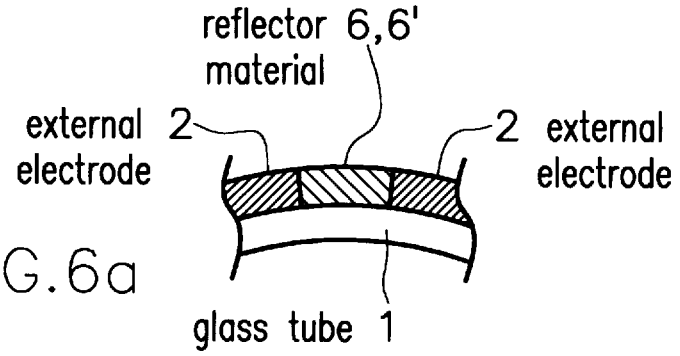
FIGS. 6(*a*)–6(*c*) each show a schematic of the installation of the reflector material in the embodiments of the invention.
Figure 6B:
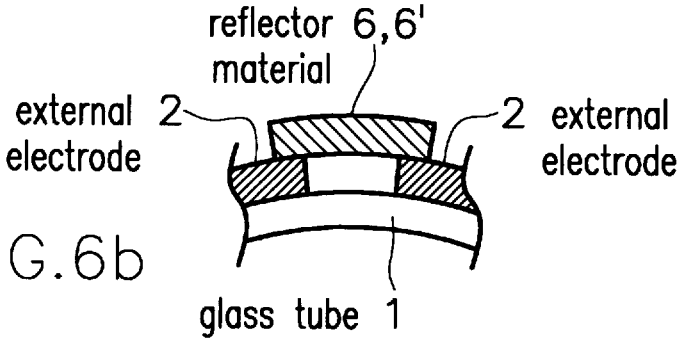
Figure 6C:
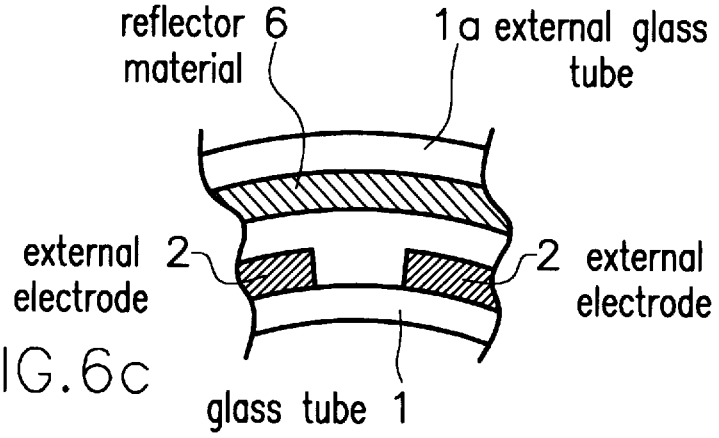

For the arrangement, reflector material 6,6' can be applied/cemented to the slit which is located in the electrode, in opening located in the electrode, and the like, as is illustrated for example in FIG. 6(*a*), or can be cemented on the outside of the slotted region, the region of an opening, and the like, as is illustrated in FIG. 6(*b*). It can be imagined that in the two embodiments the same effect is achieved. Furthermore, reflector material 6 can be installed at a distance from external electrode 2, 2' and the light reflected by reflector material 6 can be guided back to the inside of the glass tube. Specifically, reflector material 6 as illustrated in FIG. 6(*c*) can be located on the inside of outer glass tube 1*a* which is located at a stipulated distance from external electrodes 2, 2'.

Figure 9:
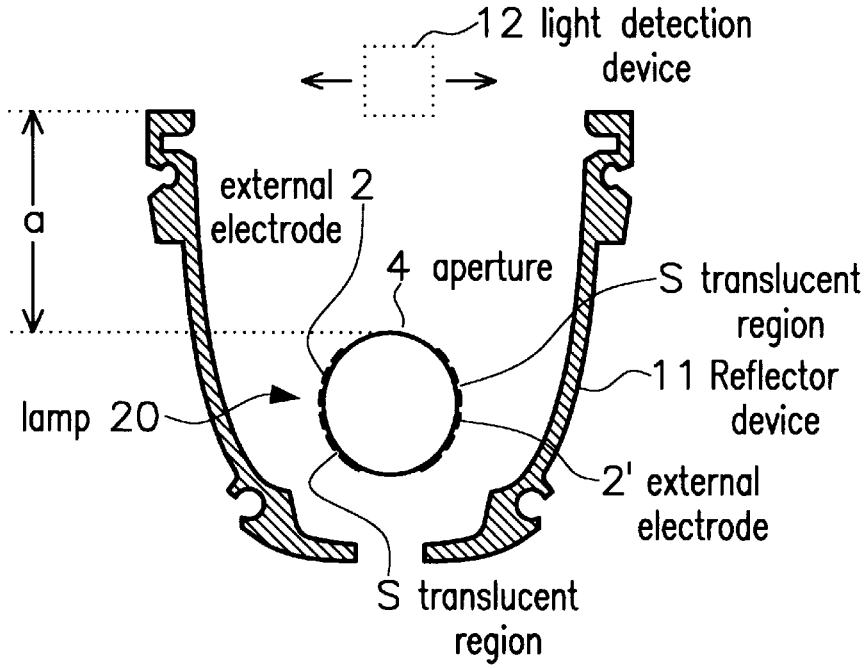
FIG. 9 shows a schematic of an arrangement of a first embodiment of an irradiation unit of the invention.

FIG. 9 is a schematic of the arrangement of a first embodiment of an irradiation unit of the invention. The drawing shows the arrangement of an irradiation unit which is used for back light device of a liquid crystal display cell. FIG. 9 is a cross section perpendicular to the tube axis of a fluorescent lamp of the external electrode type of the irradiation device in this embodiment. Reference number 20 labels a fluorescent lamp of the external electrode type in which the external electrodes are provided with translucent regions, and reference number 11 labels a U-shaped reflector device for which aluminum was used, the inside of the U-shape having been subjected to mirror finishing.

Figure 10:
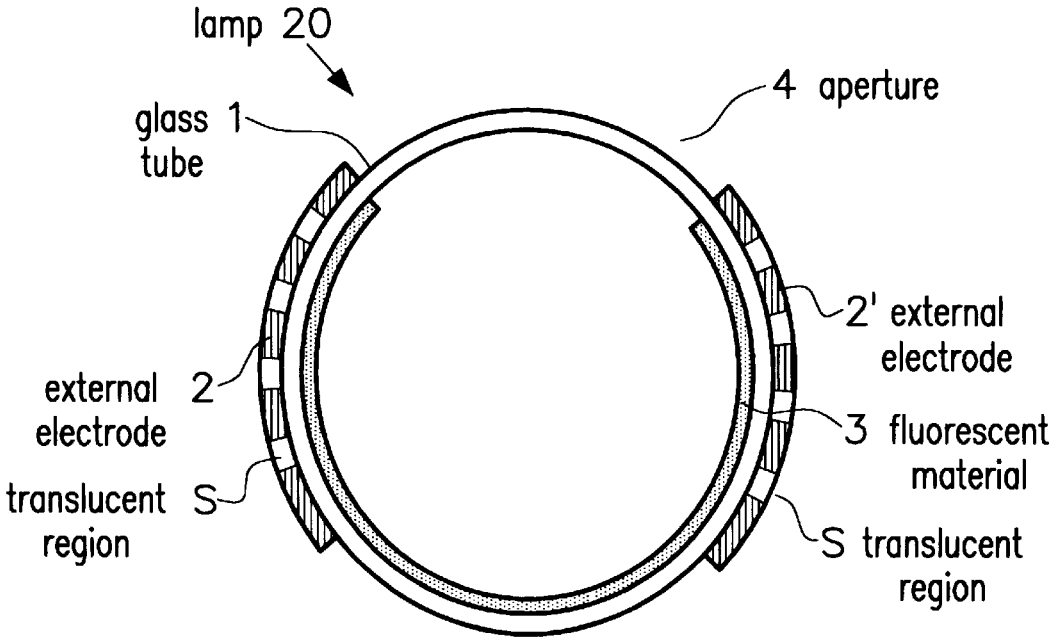
FIG. 10 shows a cross section perpendicular to the tube axis of the fluorescent lamp of the external electrode type, in which the electrodes are provided with translucent regions.

FIG. 10 is a cross section perpendicular to the tube axis of a fluorescent lamp of the external electrode type (hereinafter called "lamp") in which the external electrodes are provided with translucent regions S. The outside of glass tube 1 is provided with a pair of strip-like external electrodes 2, 2' which have translucent regions S such as openings, slits the like. Glass tube 1 is filled with rare gas or the like, and on the inside of glass tube 1 fluorescent material 3 is applied. The lamp is operated like the lamp described above using FIG. 8 by applying an uninterrupted high frequency voltage or pulse-like high frequency voltage to external electrode 2, 2'.

The lamp described above using FIG. 5 can be used for lamp 20.

In the irradiation unit with the arrangement in FIG. 9, when lamp 20 is being operated light is emitted to the outside from aperture 4 and at the same time light is emitted from translucent regions S which are located in external electrodes 2, 2'. The light emitted from translucent regions S is reflected by reflector device 11 and is radiated from the opening of the U-shaped reflector device.

In the irradiation unit in this embodiment, the light emitted from translucent regions S is reflected by reflector device 11, emitted from the opening of the U-shaped reflector device, and used. Therefore the light intensity can be increased compared to the conventional case of using a lamp which is not provided with translucent regions S.

To confirm the action in this embodiment, using the irradiation unit shown in FIG. 9 a experiment was run in which a lamp without translucent regions was compared to a lamp with translucent regions.

In the experiment with the irradiation unit in FIG. 9, a lamp with a length of 370 mm and a tube diameter of 8 mm with translucent regions and a lamp without translucent regions were located at a site 30 mm away from the opening of U-shaped reflector device 11 (distance a in FIG. 9=30 mm). Here light detection device 12 located in the opening of U-shaped reflector device 11 was moved in the direction of the arrow in the drawing and the light intensity distribution was measured.

A pulse-like voltage of 1600 V and 75 kHz was applied to the lamp for operation. The input voltage of a transformer which was used to generate the pulse-like voltage was 24 V and the input current thereof was 0.6 A.

Figure 11:
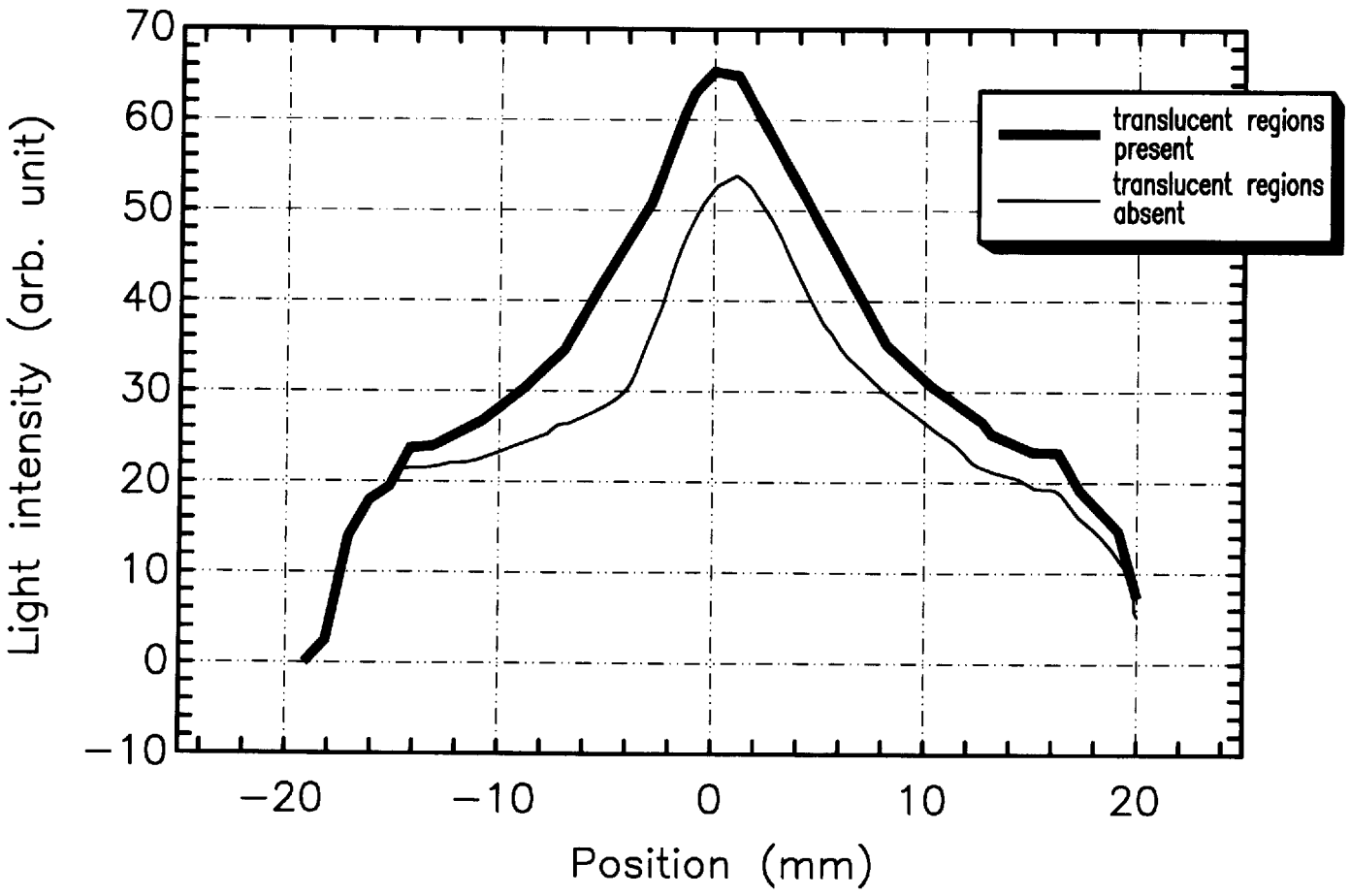
FIG. 11 shows a schematic of the result of a comparison experiment in the first embodiment.

FIG. 11 schematically shows the measurement result. In the drawing the thick line shows the distribution of the illuminance in the case of using a lamp with translucent regions, while the thin line shows the distribution of illuminance in the case of using a lamp without translucent regions. The X-axis shows the position of light detection device 12 shown in FIG. 9 (the center of the optical axis as 0 mm) and the Y-axis shows the intensity of the light received by light detection device 12.

As the drawing clearly shows, the intensity of the light emitted from the irradiation unit in the case of using the lamp with the translucent regions is increased more strongly than in the case of using the lamp without translucent regions. This confirms the action in this embodiment.

Figure 12:
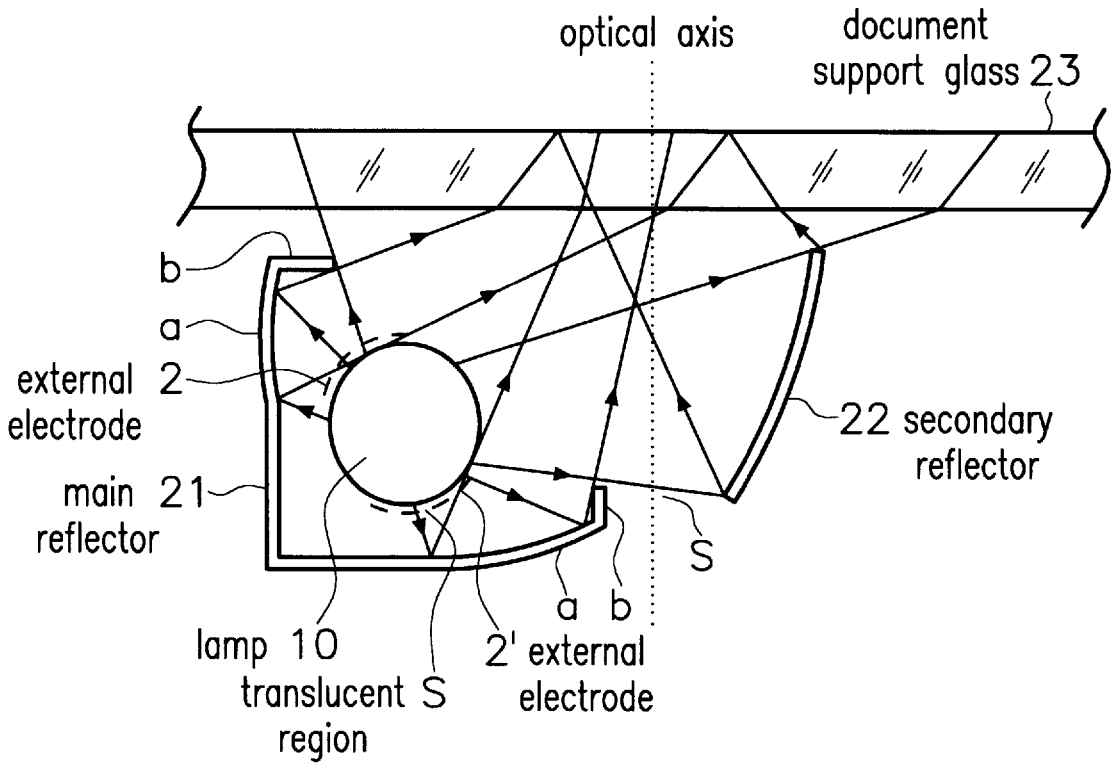
FIG. 12 shows a schematic of the arrangement of a second embodiment of the irradiation unit of the invention.

FIG. 12 is a schematic of the arrangement of a second embodiment of the irradiation unit. In the drawing the arrangement of an irradiation unit is shown which is used for document scanning illumination of an information processing device. FIG. 12 is a cross section perpendicular to the tube axis of the lamp of the irradiation unit. Here reference number 10 labels a lamp in which the external electrodes are provided with translucent regions, reference number 21 a main reflector, reference number 22 a secondary reflector, reference number 23 a document support glass on which the document to be scanned is placed.

Main reflector 21 is arranged such that it surrounds lamp 10. In the drawing, regions a are made roughly oval or in the form of a circular curve in order to be able to focus the light. Furthermore, ends b of main reflector 21 are bent so that the light emitted from lamp 10 is not directly incident on an image pick-up element which is not shown in the drawing. Secondary reflector 22 is made roughly oval or in the form of a circular curve and focusses the light emitted from lamp 10.

In the irradiation unit with the arrangement in FIG. 12 the light emitted from aperture 4 and translucent regions S of lamp 10 is radiated directly onto document support glass 23. The light is simultaneously reflected by main reflector 21 and secondary reflector 22 and radiated onto document support glass 23. This light is reflected from the surface of the document placed on the document support glass and is incident via slit S located between main reflector 21 and secondary reflector 22 and via an optical system from a mirror, a lens and the like on an image pick-up element (not shown in the drawing) such as a CCD or the like.

In the irradiation unit in this embodiment the light emitted from aperture 4 and translucent regions S of lamp 10 is radiated onto the document surface on document support glass 23 after reflection from main reflector 21 and secondary reflector 22. Therefore, as in the first embodiment, the amount of light emerging compared to the case of using the lamp which is not provided with translucent regions S can be increased.

To confirm the action in this embodiment, using the irradiation unit shown in FIG. 12 a experiment was run in which a lamp without translucent regions was compared to a lamp with translucent regions.

In the experiment with the irradiation unit in FIG. 12 a lamp with a length of 370 mm and a tube diameter of 8 mm which has translucent regions and a lamp without translucent regions were used. As in the first embodiment, a light detection device was moved on the document surface and the light intensity distribution was measured. The operating conditions are also the same as in the first embodiment.

Figure 13:
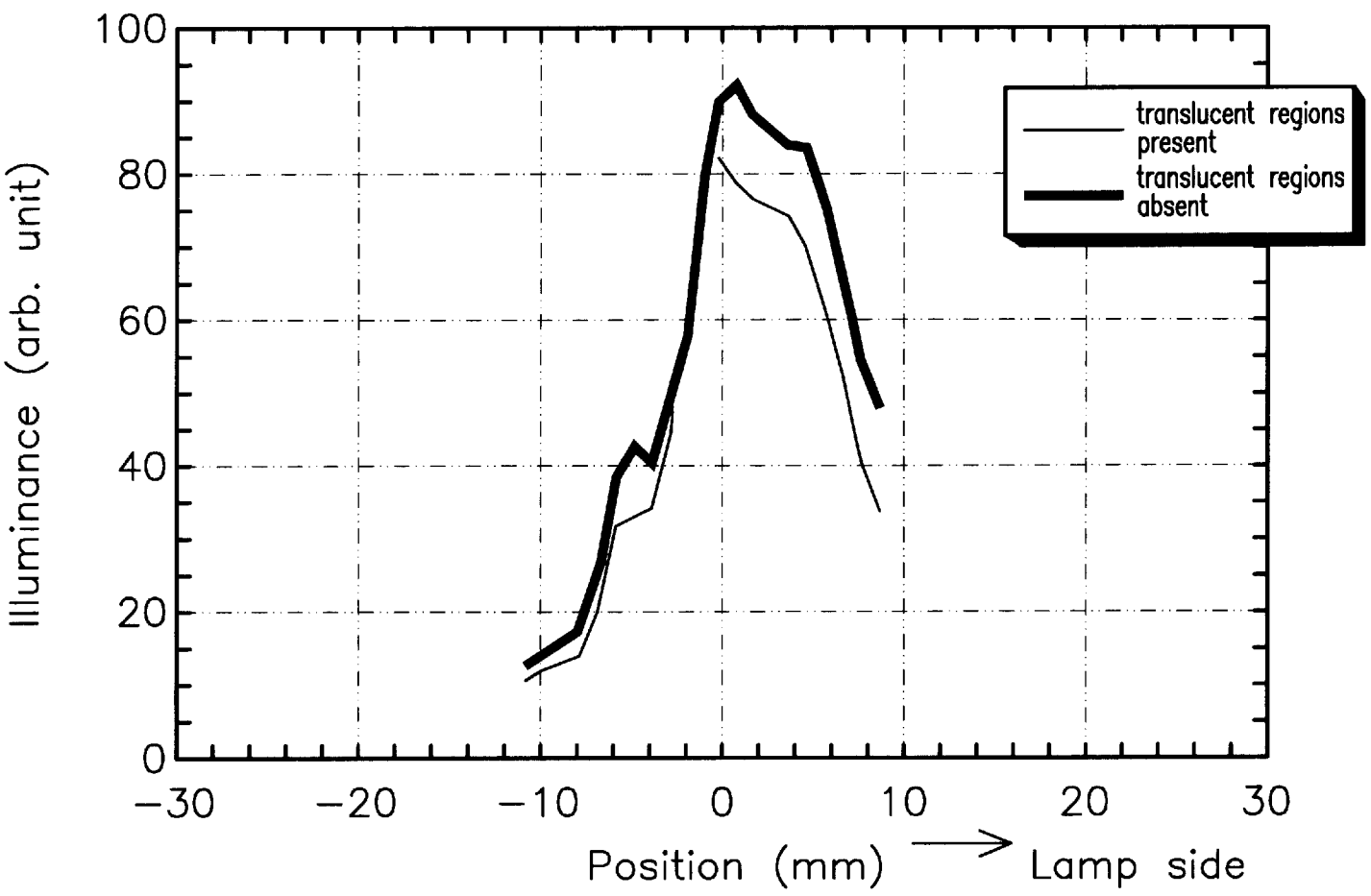
FIG. 13 shows a schematic of the result of a comparison experiment in the second embodiment.

FIG. 13 schematically shows the measurement result. In the drawing, the thick line shows the distribution of illuminance intensity in the case of using a lamp with translucent regions, while the solid line shows the distribution of illuminance in the case of using a lamp without translucent regions. The x-axis shows the distance from the optical axis in the direction which orthogonally intersects the lamp tube axis on the document support glass and the y-axis shows the light intensity at the respective point. In the figure the direction of the "lamp side" arrow represents the side on which lamp 10 is located in FIG. 12.

As is apparent from the drawing, in this embodiment the intensity of the light emitted from the irradiation unit in the case of using a lamp with translucent regions is increased more strongly than in the case of using the lamp without the translucent regions. In this way the action in this embodiment is confirmed.

Furthermore, the light intensity distribution was measured in a conventionally used irradiation unit for document scanning illumination and in the irradiation unit in this embodiment, the action of the irradiation unit having been confirmed in this embodiment.

Figure 14:
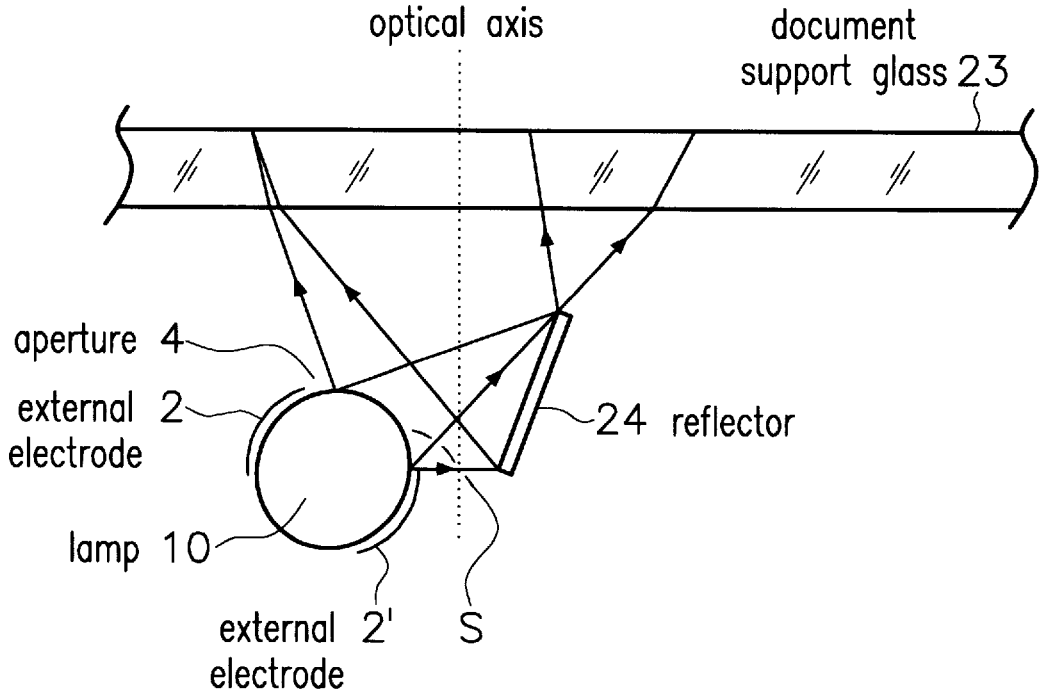
FIG. 14 shows a schematic of the arrangement of a conventional irradiation unit which was used in a experiment according to FIG. 15.

FIG. 14 is a schematic of the arrangement of the conventional irradiation unit for document scanning illumination which was used in the comparison experiment.

In the drawing reference number 10 labels the lamp shown above using FIG. 7, in which the external electrodes are not provided with translucent regions, reference number 23 labels a document support glass, and reference number 24 a reflector.

In the irradiation unit in FIG. 14 the light is emitted from the aperture of lamp 10 without translucent regions and is radiated directly onto the document surface on the document support glass. At the same time it is reflected from reflector 24 and radiated onto the surface of the document which is placed on document support glass 23. The light reflected thereby is incident via slit S located between lamp 10 and reflector 24 and via an optical system and a lens which are not shown onto an image scanning means such as a CCD or the like.

In the irradiation unit shown in FIGS. 12 and 13 a lamp with a length of 370 mm and a tube diameter of 8 mm was used, as was described above. The lamp was operated under the same operating conditions as in the above described example, a light detection device having been moved on the document surface and the light intensity distribution having been measured.

Figure 15:
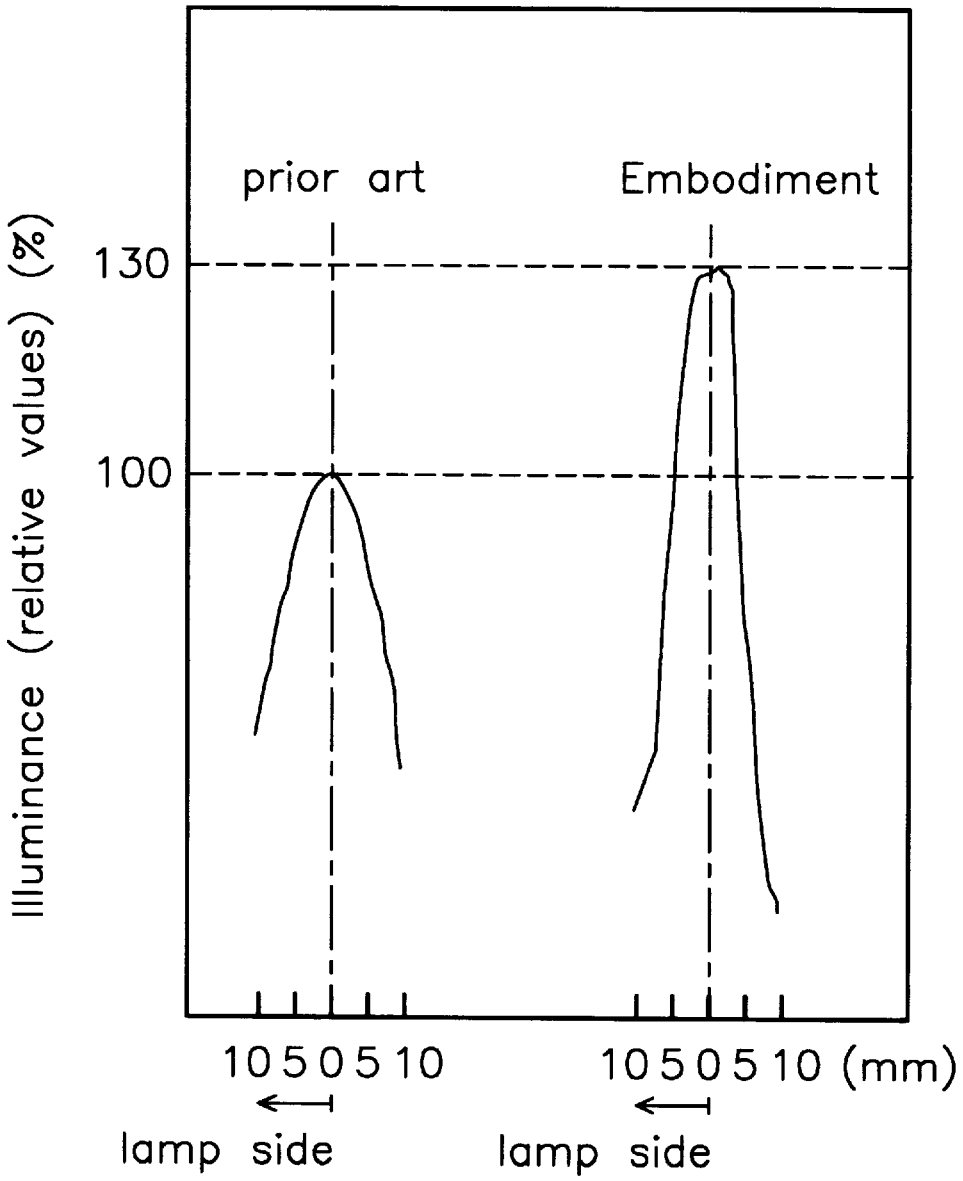
FIG. 15 shows a schematic of a measurement result of the distribution of the light intensity of the irradiation units shown in FIGS. 12 and 13.

FIG. 15 schematically shows the result of the experiment. On the left the distribution of the illuminance of the irradiation unit in FIG. 14 as shown and on the right is the distribution of the illuminance of the irradiation unit in FIG. 12 for this embodiment is shown.

In the drawing the x-axis shows the distance from the optical axis in the direction which orthogonally intersects the lamp tube axis on the document support glass and the y-axis plots the illuminance at the respective point (relative values, the peak illuminance of the conventional irradiation unit being designated as 100 in FIG. 7). In this case the direction of the "lamp side" arrow represents the side on which the lamp in FIGS. 12 and 14 is located.

As is apparent from the drawing, by using the irradiation unit in this embodiment an illuminance on the document surface can be obtained which is roughly 1.3 times greater than in the conventional irradiation unit shown in FIG. 7. It was therefore confirmed that by using the irradiation unit in this embodiment the illuminance on the document surface compared to the case of using the convention irradiation unit can be increased significantly.

Possibility of Commercial Use

As was described above, the fluorescent lamp of the external electrode type as claimed in the invention and the irradiation unit using this fluorescent lamp can be used for document scanning illumination which is used for a fax machine, a copier, a image reader and the like, and for a back light device of a liquid crystal display cell and for similar purposes.

We claim:

1. A fluorescent lamp, in which a glass tube with fluorescent material applied to its inside is hermetically filled with a suitable amount of rare gas, in which in the axial direction of the outside surface of the glass tube there is at least one pair of electrodes, and in which there is an aperture for emission of the light to the outside, characterized in that the electrodes have at least partially translucent regions and reflector material located in the translucent regions.

2. The lamp as claimed in claim 1, wherein the translucent regions are located in the vicinity of the aperture.

3. Irradiation unit using a fluorescent lamp, in which a glass tube with a fluorescent material applied to its inside and being hermetically filled with a suitable amount of rare gas, in the axial direction of the outside surface of the glass tube at least one pair of electrodes being located, and there being one aperture for emission of light to the outside, characterized in that the electrodes have at least partially translucent regions, a reflector device is located at a distance from the fluorescent lamp, and wherein the light passed by the electrodes is at least partially reflected by the reflector device in an area which is irradiated with the radiant light from the aperture.

* * * * *